US012276486B2

(12) United States Patent
Thuman et al.

(10) Patent No.: US 12,276,486 B2
(45) Date of Patent: Apr. 15, 2025

(54) METHOD FOR PRODUCING A WARHEAD COMPONENT

(71) Applicant: BAE SYSTEMS BOFORS AB, Karlskoga (SE)

(72) Inventors: Christer Thuman, Karlskoga (SE); Hamzah Hamdan, Karlskoga (SE); Fredrik Thuvander, Karlstad (SE); Oskar Malmqvist, Hallsberg (SE); Björn Johansson, Karlskoga (SE); Alexander Bark, Örebro (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 18/561,330

(22) PCT Filed: Apr. 30, 2022

(86) PCT No.: PCT/SE2022/050418
§ 371 (c)(1),
(2) Date: Nov. 16, 2023

(87) PCT Pub. No.: WO2022/245264
PCT Pub. Date: Nov. 24, 2022

(65) Prior Publication Data

US 2024/0240925 A1 Jul. 18, 2024

(30) Foreign Application Priority Data

May 19, 2021 (SE) ..... 2100078-1

(51) Int. Cl.
*F42B 12/32* (2006.01)
*F42B 33/00* (2006.01)

(52) U.S. Cl.
CPC ..... *F42B 12/32* (2013.01); *F42B 33/00* (2013.01)

(58) Field of Classification Search
CPC ..... F42B 12/22; F42B 12/24; F42B 12/56; F42B 12/58; F42B 12/60; F42B 12/62; F42B 12/64; F42B 12/32; F42B 33/00
(Continued)

(56) References Cited

U.S. PATENT DOCUMENTS 3,298,308 A 1/1967 Throner, Jr.
3,815,504 A 6/1974 Tieben
(Continued)

FOREIGN PATENT DOCUMENTS

EP 0108741 A1 5/1984
FR 2692034 A1 12/1993
(Continued)

OTHER PUBLICATIONS

International Search Report (2022-06-02) for corresponding International App. PCT/SE2022/050418.

*Primary Examiner* — James S Bergin
(74) *Attorney, Agent, or Firm* — WRB-IP PLLC

(57) ABSTRACT

A method is provided for producing a warhead component including an inner shell. The method includes arranging a first casing of a thermoplastic to enclose the inner shell, arranging pre-formed projectiles between the first casing of thermoplastic and the inner shell, and heat-treating the first casing so that the first casing shrinks and fixes the pre-formed projectiles to the inner shell. A warhead, a projectile, and a bomb are also provided.

10 Claims, 5 Drawing Sheets

(58) Field of Classification Search
USPC ..... 86/51, 53; 102/496, 497
See application file for complete search history.

(56) References Cited

U.S. PATENT DOCUMENTS

| | | | | | |
|---|---|---|---|---|---|
| 3,945,321 | A * | 3/1976 | Mayer | F42B 12/32 | 86/20.12 |
| 4,032,335 | A | 6/1977 | Zapf et al. | | |
| 4,383,468 | A * | 5/1983 | Sie | F42B 12/32 | 264/122 |
| 10,267,607 | B2 * | 4/2019 | Bootes | F42B 12/04 | |
| 10,408,589 | B1 * | 9/2019 | Chen | F42B 33/001 | |
| 10,502,538 | B1 * | 12/2019 | Thuman | F42B 12/32 | |
| 11,041,704 | B1 * | 6/2021 | Ellis | B22F 7/08 | |
| 11,187,508 | B2 * | 11/2021 | Thuman | F42B 12/24 | |
| 11,226,181 | B2 * | 1/2022 | Rastegar | F42B 12/24 | |
| 11,953,299 | B2 * | 4/2024 | Thuman | F42B 12/32 | |
| 12,135,196 | B2 * | 11/2024 | Thuman | F42B 33/00 | |
| 2009/0211484 | A1 | 8/2009 | Truitt et al. | | |
| 2016/0377398 | A1 | 12/2016 | Daebelliehn et al. | | |
| 2023/0358519 | A1 * | 11/2023 | Thuman | F42B 33/001 | |
| 2024/0035790 | A1 * | 2/2024 | Vestlund | F42B 12/32 | |

FOREIGN PATENT DOCUMENTS

| | | | |
|---|---|---|---|
| GB | 2164131 | A | 3/1986 |
| WO | 2020190192 | A1 | 9/2020 |

* cited by examiner

METHOD FOR PRODUCING A WARHEAD COMPONENT

BACKGROUND AND SUMMARY

This invention relates to a method for the manufacturing of the components of a warhead, as well as a projectile outfitted with a warhead, and a bomb equipped with a warhead.

The fact that the warheads are equipped with pre-formed fragments/shrapnel/projectiles has long been known by experts. By selecting the type of pre-formed projectiles used, the effect of the warhead can be tailored to the target. Depending on the type of target to be engaged, the number of pre-formed projectiles, the size of the pre-formed projectiles, the material of the pre-formed projectiles, and the shape of the pre-formed projectiles, can be determined. When the warhead breaks apart, the pre-formed projectiles and the pre-formed fragments, will disperse with a predetermined size, velocity, and mass. It is also possible to influence the direction in which the pre-formed projectiles are dispersed by means of their positioning and arrangement.

Another way of producing projectiles of a predetermined size and mass according to experts, other than the arrangement of pre-formed projectiles, is to produce a controlled fragmentation of the warhead. This is usually achieved by arranging the weaknesses in the warhead, e.g. by machining grooves in the warhead material/shell, so that a division of the warhead occurs according to the location of said weaknesses upon fragmentation/detonation. The grooves can be added to the warhead by machining, as well as directly during manufacturing, for example by casting, additive manufacturing or other manufacturing methods.

It is also common to combine the arrangement of pre-formed projectiles with controlled fragmentation in a single warhead.

In order to arrange pre-formed projectiles, a rubber fixture is often used during part of the manufacturing process. The production of the rubber fixture itself is relatively costly and labor-intensive. Flexibility in developing a new product or adapting/modifying an existing product is also limited as new shapes and geometries require a new rubber molding tool which results in long lead times, development time, and therefore high costs. Similarly, it is often difficult and labor-intensive to achieve controlled fragmentation by milling grooves in the warhead material.

An example of a manufacturing method for a warhead with pre-formed projectiles is included in patent specification U.S. Pat. No. 3,815,504, which indicates a manufacturing method for warhead/projectiles as well as warhead/projectiles manufactured by positioning two tubular bodies coaxially around each other with a distance corresponding to the diameter of the constituent splinters/fragments/munitions arranged between the two tubular bodies. Internal pressure shapes the tubular bodies around the splinters/fragments/munitions as the device is arranged with external resistance.

An alternative example of a manufacturing method for a warhead with pre-formed projectiles is included in patent specification U.S. Pat. No. 4,032,335, which indicates a process for producing a composite material consisting of or comprising metal powder and fragments/pre-formed projectiles, jointly arranged against a metal structure. By subjecting the composite to isostatic compressive pressure, the metal powder is embedded in the surrounding metal.

A further example of an alternative method of manufacturing a warhead with pre-formed projectiles is included in patent specification US 2009/0211484 A1, which indicates components and methods for the manufacturing of a workpiece component comprising individual pre-formed fragments embedded in a reactive material or an inert material such as a polymer.

A common aspect to the above known techniques is the fact that the arrangement of the pre-formed projectiles is time consuming, technically difficult, costly and/or difficult to repeat with the same output. Furthermore, known technologies include manufacturing problems related to occupational health and safety issues.

It is desirable to provide a simpler, faster, and more cost-effective means of producing a warhead component, and thus a simpler, faster and more cost-effective means of producing a warhead, with pre-formed projectiles and/or a controlled fragmentation. Furthermore, the new method provides an improved working environment compared to known methods for manufacturing warhead components.

The invention relates, according to an aspect thereof, to a method of producing a warhead component comprised of an inner shell, wherein, the method comprises the following steps:

- a first casing of a thermoplastic is arranged enclosing the inner shell, pre-formed projectiles are arranged between the first thermoplastic casing and the inner shell,
- the first casing is heat-treated so that it shrinks and fixes the pre-formed projectiles to the inner shell.

According to additional aspects of a method for regulating the attachment of a warhead component, the following applies;

- that the first casing is provided with an opening in which the pre-formed projectiles can be arranged.
- that a second casing is arranged on the first casing, where the first casing is outfitted with an opening, after the pre-formed projectiles are arranged between the first casing and the inner shell. that the inner shell is the framework of a shell body.
- that a metal casing is arranged on the joint component including the first casing, and possibly the second casing, enclosing, against the inner shell, the pre-formed projectiles.
- that a metal powder is arranged by hot isostatic pressing on the common component of the warhead comprising a first casing, possibly a second casing, fixing the preformed projectiles against the inner shell whereby the first casing, and possibly the second casing, is vaporized during the process of hot isostatic pressing.
- that the mantle surface of the inner shell is arranged with recesses in the form of bullet bowls.

The invention further includes, according to an aspect thereof, a warhead produced by means of the method described above.

The invention furthermore comprises, according to an aspect thereof, a projectile that contains a warhead.

The invention further includes, according to an aspect thereof, a bomb comprising a combat component.

By manufacturing warhead/projectile components and/or projectiles with a pre-formed projectile, according to the demonstrated method, a projectile can be manufactured faster, cheaper, easier and with less problems related to the working environment than previously known manufacturing methods.

BRIEF DESCRIPTION OF THE DRAWINGS

The invention will be described below by reference to the figures that are included there.

DETAILED DESCRIPTION

Figure 1:
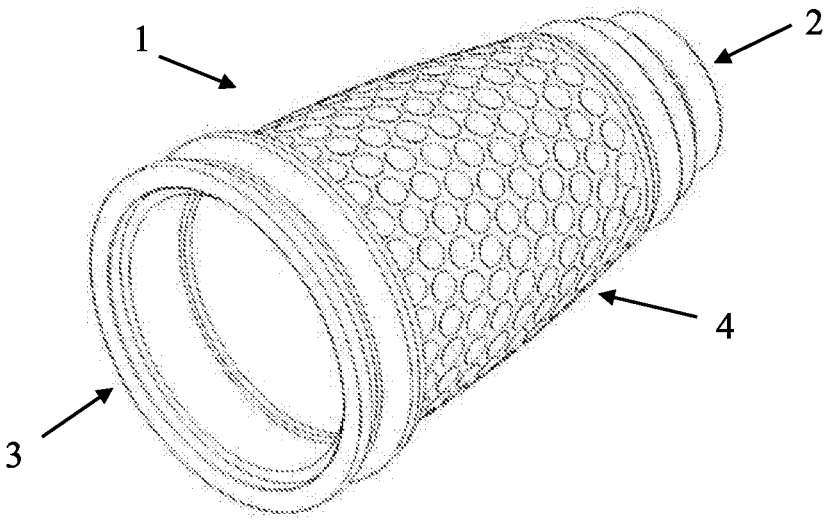
FIG. 1 shows a perspective view of a shell body for a warhead according to one embodiment of the invention.

The present invention indicates a number of embodiments relating to a manufacturing method for warheads/fuses as well as for projectiles and grenades, FIG. 1 shows the inner shell 1 of a warhead according to a first embodiment of the invention. The inner shell 1, the body of the warhead, where the warhead is also referred to as the fuse or shell body, is produced by, for example, cutting operations, such as turning, or additive manufacturing, but can also be produced by, for example, casting, pressing or drawing. The inner shell 1 can also be made of a spacer material that can be used as a component in the manufacture of projectiles, in which case the inner shell can be placed within a warhead frame as a step in the manufacturing process to produce a warhead/fuse. A warhead is a device adapted to combat a target and may also be referred to as a fuse and may consist of or comprise a projectile, such as a grenade, or be a component of a projectile such as a grenade or submunition. The inner shell 1 is hollow, to allow the placement of an explosive substance therein. The inner shell 1 is also designed to receive a nose section and an aft section at its front 2 and 3 rear parts respectively. The nose section and the stern section can be given a variety of designs, depending on the desired characteristics of the warhead, such as different forms of nose section in the form of different fuses, as well as stern sections adapted, for example, for cartridges or other stern sections suitable for projectiles. The inner shell 1 is preferably made of some material that experts recognize as suitable for the purpose, usually a metallic material, but it may also be a plastic or a composite, and a variety of examples of materials are already known in the field of engineering. The inner shell 1 may be arranged with recesses 4, also referred to as bullet bowls, in which the pre-formed projectiles may be arranged. The inner shell acts as a driving mirror for the pre-formed projectiles arranged in the recesses 4, which affects the ballistic trajectory of the pre-formed projectiles when detonating the fuse.

Figure 2:
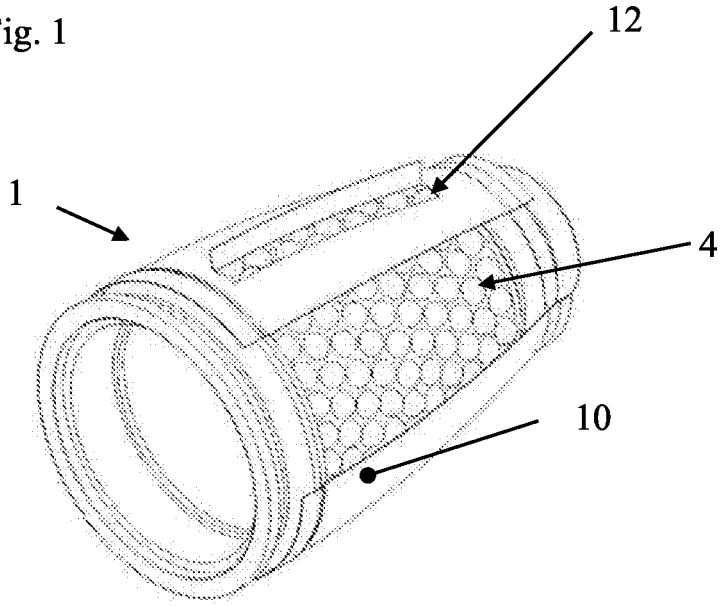
FIG. 2 shows a perspective view of a shell body for a warhead, arranged with an enclosing first casing, according to an embodiment of the invention.

FIG. 2 shows an inner shell 1, preferably made of machined metal, for example by conventional turning or manufactured by an additive manufacturing method. Instructions, recesses 4 in each projectile are provided in the inner shell 1 of the embodiment shown. An enclosing first casing 10 is arranged around the inner shell 1 and an outlet 12, a slot, is arranged in the first casing 10. The first casing 10 is arranged around, or enclosing, the inner shell 1, enclosing means that the first casing, around the outer diameter of the inner shell, encloses the inner shell in radial direction along the axial extension of the inner shell as also shown in the figures.

The enclosing casing is shown in FIG. 2 with an opening to demonstrate the location of the recesses 4 below the enclosing of casing 10. Pre-formed projectiles are arranged through outlet 12 so that they are partially arranged in the recesses 4. In the embodiment shown, bullet-shaped projectiles are used, so the recesses are bullet bowls, i.e. a bowl-shaped design adapted for a bullet. In one embodiment, the spherical projectiles are arranged through outlet 12 so that all recesses 4 are arranged with a spherical projectile after which the inner shell 1 is turned so that the next row of recesses 4 becomes visible in the recess 12 after which the next row is arranged with spherical projectiles after which the inner shell 1 is turned again to expose the next row of recesses 4 in outlet 12. The process is repeated until all recesses 4 are arranged with a spherical projectile. Preferably, outlets 12 are arranged vertically with the opening facing upwards so that gravity retains mounted balls in recesses 4. When the inner shell 1 is rotated, the already mounted spherical projectiles are retained by the first casing 10. The pre-formed projectiles may also be referred to as fragments and/or shrapnel. In the embodiment shown in FIG. 2, the pre-formed projectiles are bullet-shaped/spherical but can be varied according to the field of application.

Figure 3:
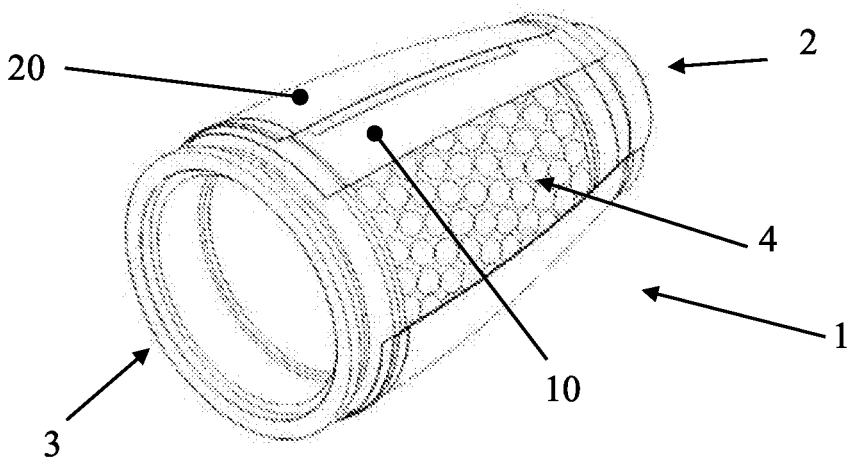
FIG. 3 shows a perspective view of a shell body of a warhead arranged with an enclosing first casing and an enclosing second casing, according to an embodiment of the invention.

FIG. 3 shows a step in the manufacture of a warhead, according to the invention. A second casing 20 is arranged over the first casing 10. Both the first casing 10 and the second casing 20 extend along part or all of the inner shell 1 in the axial direction, but in the preferred embodiment, the front 2 and rear 3 ends are left free for connection to nose and stern portions respectively. The second casing 20 is not provided with any opening 12, therefore the second casing 20 encloses the first casing 10 and prevents the pre-formed projectiles arranged between the inner shell 1 and the first casing 10 from falling out or otherwise being separated or displaced from their respective recesses 4. The material of manufacture of the first casing 10 and the second casing 20 is preferably a polymer selected so that the material has properties such as thermal properties/melting point, strength and the ability not to affect subsequent manufacturing processes.

Figure 4:
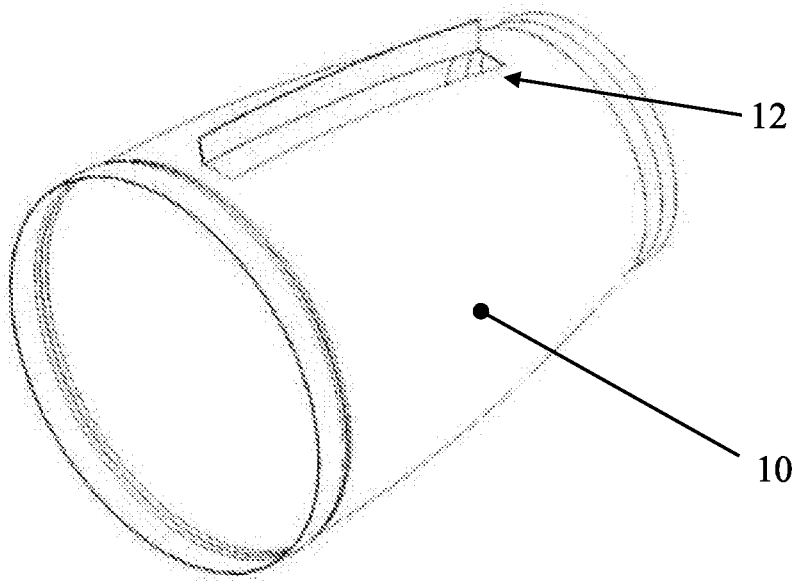
FIG. 4 shows a perspective view of a first casing according to an embodiment of the invention.

FIG. 4 shows the first casing 10 was arranged with an opening 12. The first casing is preferably made of a polymer, also referred to as plastic, such as a thermoplastic, for example a thermoplastic polyester. An example of a suitable material is polyethylene terephthalate, also known as PET, or another high molecular weight thermoplastic polymer such as HDPE, High Density Polyethylene. The first casing is designed to fit on an inner shell arranged with pre-formed projectiles, i.e. the inner radius of the first casing 10 makes it so it can be arranged on the inner shell 1 and that pre-formed fragments can be arranged on the inner shell and retained by the first casing 10, i.e. between the inner shell 1 and the first casing 10.

Figure 5:
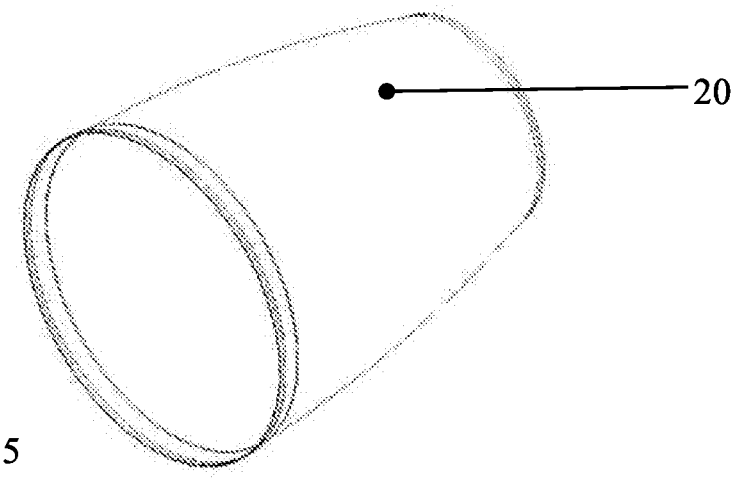
FIG. 5 shows a perspective view of a second casing according to an embodiment of the invention.

FIG. 5 shows the second casing 20. The second casing is also preferably made of a polymer, also referred to as plastic, such as a thermoplastic, for example a thermoplastic polyester. Examples of suitable materials are PET or HDPE. The second casing 20 is designed to fit over the first casing 10.

During the manufacture of the first casing 10 and the second casing 20, the plastic is stretched to an expanded state into the shape that is suitable for arrangement on the inner shell 1. The plastic can be thermoformed, extruded or blown into the desired shape. In blow-molding, raw material in the form of a polymer tube, that is extruded for example, can be placed in a chamber that has the desired shape. When the polymer tube is arranged in the mold, the chamber is completely closed and gas flows into the polymer tube while it is heated. The gas fills the polymer tube, and may be fitted to a screw coupling that is arranged at one end of the polymer tube, and squeezes the polymer tube so that it settles according to the shape of the chamber. The mold can then be cooled and the product removed. In the event that a casing, such as the first casing 10 or the second casing 20, is to be manufactured, the casing may be manufactured in the form of a bottle which is then machined into the shape of a casing by removing the top and bottom. When the shape-blown, and thus stretched, first casing 10 and/or second casing 20 is subjected to heat, the first casing 10 and/or second casing 20 will strive to return to the shape of a polymer tube, in other words, the first casing 10 and/or second casing 20 will shrink. The covered components will return to their original shape if the temperature exceeds the glass transition temperature but is below the melting point for plastic.

Figure 6:
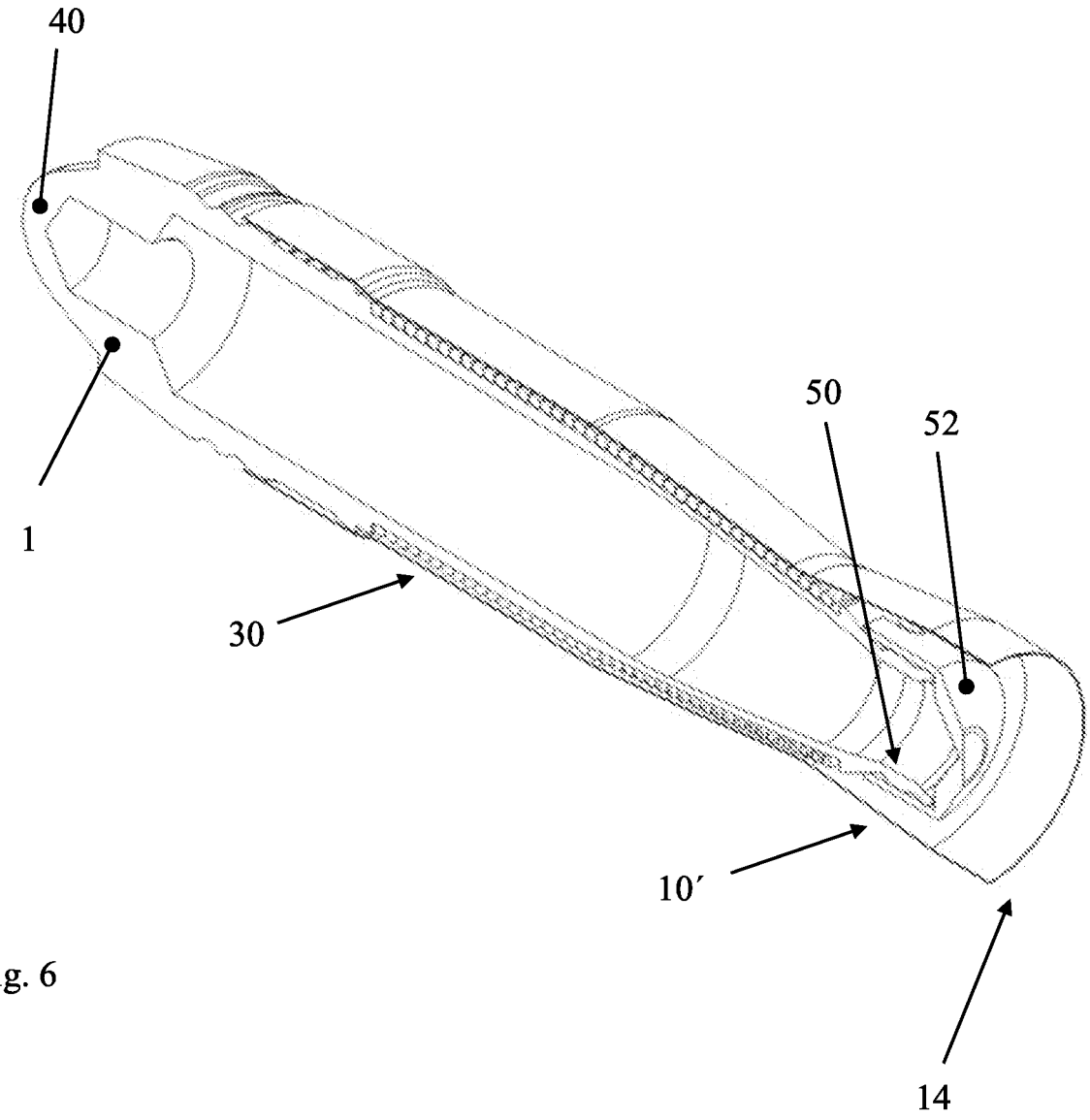
FIG. 6 shows a perspective view of a shell body for a warhead arranged with an enclosing first casing, according to an alternative embodiment of the invention.

In an alternative embodiment, as shown in FIG. 6, a first casing 10', arranged without an outlet, is arranged on an inner shell 1, which creates distance between the first casing 10' and the inner shell 1, that in turn can be filled with pre-formed projectiles, for example munitions. When the space between the first casing 10' is filled up with pre-formed projectiles in the form of, for example, munitions 30, the first casing 10' can be heat treated so that it shrinks against the inner shell 1 and thereby retains and fixes the pre-formed projectiles, munitions 30, against the inner shell 1. Heat treatment can be performed with hot air, in an oven, or with IR heaters. To facilitate the filling of pre-formed projectiles, the first casing 10' may be arranged with a funnel-shaped opening 14, in which the pre-formed projectiles may be arranged. The funnel-shaped opening can be removed after the pre-formed projectiles have been arranged between the first casing 10' and the inner shell 1. The projectile shown in FIG. 6, and hence the inner shell 1, is provided with an aft part 40, and a thread 50 for the arrangement of a primer tube. When pre-formed projectiles 30 are arranged between the first casing 10' and the inner shell 1, a plug 52 may be arranged in or on the thread 50 to avoid pre-formed projectiles 30 ending up inside the inner shell 1. The choice of material for the first casing 10' is preferably a thermoplastic, for example a thermoplastic polyester. Examples of suitable materials are PET or HDPE.

Figure 7:
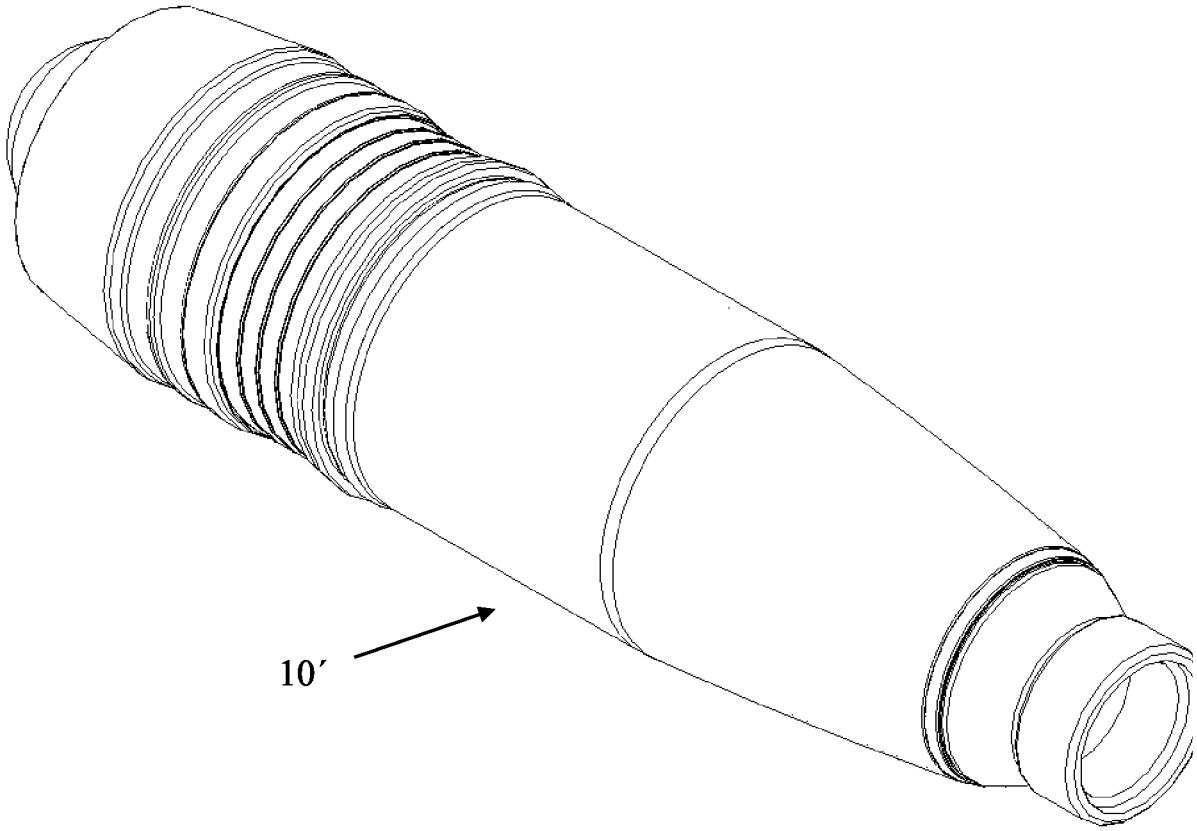
FIG. 7 shows a perspective view of a shell body for a warhead, arranged with an enclosing first casing, according to an alternative embodiment of the invention.

FIG. 7 shows the alternative embodiment where the component for a warhead is ready for further handling as part of the process of producing a complete fuse/warhead. The first casing 10' is shrunk so that the pre-formed projectiles are fixed and the first casing is machined so that parts of the casing, such as the funnel 14 shown in FIG. 6, are removed. For example, unnecessary parts can be cut with a knife, heat knife or wire cutter/heat wire, or may be otherwise removed, from the warhead component.

A fuse component includes the first casing and possibly an additional casing, such as a second casing, fixing the pre-formed projectiles to the inner shell. Once a fuse component has been manufactured, additional materials can be applied to produce a complete fuse/projectile, for example by applying an outer casing of steel or aluminum, or by applying metal powder to the fuse component by means of hot isostatic pressing, HIP. If HIP is used to apply material to the fuse component, the polymer in the first casing 10, and possibly the second casing 20, will be vaporized through pyrolysis. Pyrolysis, also known as dry distillation, is a process in which a substance is heated to a high temperature in an oxygen-free environment so that the substance breaks down without combustion. During pyrolysis, volatile substances are released in gaseous form, while a residue in solid or liquid form remains. The inner shell 1, possibly with a tool fitted to the inner shell, together with the pre-formed projectiles and the first casing 10, 10' and possibly a second casing 20 are arranged together in a HIP-container. An HIP container is a device in which powder is arranged in a manner that allows it to be shaped into a HIPPAD-body under high temperature and high pressure. After the frame, along with the pre-formed projectiles and the first casing 10, 10', and possibly a second casing 20, are arranged together in a HIP container, the powder is arranged in the HIP container. After the powder material is arranged in the HIP container, the HIP container is evacuated, vibrates, and is sealed to distribute the powder evenly in the HIP container. HIP is then carried out, i.e. a gas is used to create isostatic pressure in the HIP container by applying the gas to a connecting device fitted to the HIP container. Before the gas is applied to the HIP container, the HIP container can be vacuum-pumped or otherwise evacuated using air, or the filling gas/fluid arranged in the HIP container before evacuation. At the same time, the entire HIP container is heated. After the process, the composite body and HIP container are created and any excess material is processed away. After the body subjected to HIP has been machined, a tool may be removed from the frame. After the processing and removal of the frame is completed, the body can undergo heat treatment, which means that the now merged body is heated. After heat treatment, the material is suitable for machining, such as cutting. After the tool is removed, a hardening of the HIP subjected frame can take place.

Furthermore, to produce a complete projectile, the inner shell 1 may be filled with energetic material, and a fuse may be fitted to the nose of a fuse component, and a stern or rear part may be fitted to the fuse component in cases where a stern part has not been part of the inner shell 1.

The invention is not limited to the embodiments specifically shown, but can be varied in different ways within the framework of the claims.

For instance, it is clear that the number of pre-formed projectiles, choice of material, choice of polymer and geometric shapes, the included elements and details, are to be adapted to it or to one or several weapons systems, platforms and other construction-related properties which are applicable in each individual case.

Furthermore, the invention encompasses all types of warheads, fuses, projectiles, including grenades, high-explosive shells, bombs, missiles and rockets. It also includes other forms of warheads such as hand grenades and different types of mines.

The invention claimed is:

1. A method of manufacturing a component for a warhead including an inner shell, wherein the method includes the following steps:

arranging a first casing of a thermoplastic around the inner shell, arranging pre-formed projectiles between the first thermoplastic casing and the inner shell, and heat treating the first casing so that the first casing shrinks and fixes the pre-formed projectiles to the inner shell.

2. A method according to claim 1, wherein the first casing includes an opening, the method comprising arranging the pre-formed projectiles through the opening.

3. A method according to claim 2, wherein a second casing is arranged on the first casing after the pre-formed projectiles are arranged between the first casing and the inner shell.

4. A method according to claim 3, wherein a metal casing is arranged on a joint component including the first casing.

5. A method according to claim 3, comprising providing a metal powder by means of hot isostatic pressing on the warhead, fixing the pre-formed projectiles against the inner shell whereby the first casing is vaporized during the process of hot isostatic pressing.

6. A method according to claim 1, wherein the inner shell is a shell body frame.

7. A method according to claim 1, wherein a mantle surface of the inner shell is arranged with recesses in the form of bullet bowls.

8. A warhead produced by a method specified in claim 1.

9. A projectile incorporating a warhead as defined in claim 8.

10. A bomb incorporating a warhead as defined in claim 8.

* * * * *